US010674586B1

(12) United States Patent
Deng et al.

(10) Patent No.: US 10,674,586 B1
(45) Date of Patent: Jun. 2, 2020

(54) UNIVERSAL LED TUBE AND MODULE THEREOF

(71) Applicant: Jiangxi Jingke Electronics Co., Ltd., Guixi (CN)

(72) Inventors: Shuxing Deng, Shenzhen (CN); Shexi Zhang, Shenzhen (CN)

(73) Assignee: JIANGXI JINGKE ELECTRONICS CO., LTD., Guixi (CN)

( * ) Notice: Subject to any disclaimer, the term of this patent is extended or adjusted under 35 U.S.C. 154(b) by 0 days.

(21) Appl. No.: 16/660,793

(22) Filed: Oct. 22, 2019

(51) Int. Cl.
*H05B 45/37* (2020.01)

(52) U.S. Cl.
CPC ..... *H05B 45/37* (2020.01)

(58) Field of Classification Search
None
See application file for complete search history.

(56) References Cited

U.S. PATENT DOCUMENTS

| | | | | |
|---|---|---|---|---|
| 9,781,785 | B2 * | 10/2017 | Hong | G01R 31/44 |
| 2012/0306403 | A1 * | 12/2012 | Chung | H05B 45/37 315/291 |
| 2016/0109070 | A1 * | 4/2016 | Davenport | F21V 25/00 362/221 |
| 2016/0330816 | A1 | 11/2016 | Ivey et al. | |
| 2017/0105263 | A1 * | 4/2017 | Xiong | F21V 3/061 |
| 2017/0311398 | A1 * | 10/2017 | Jiang | H05B 45/395 |
| 2017/0354006 | A1 * | 12/2017 | Luo | H05B 45/50 |
| 2017/0359881 | A1 * | 12/2017 | Hsia | F21V 25/12 |
| 2018/0224074 | A1 * | 8/2018 | Xiong | F21V 29/70 |
| 2018/0249538 | A1 * | 8/2018 | Zijlstra | H05B 45/00 |
| 2019/0154246 | A1 * | 5/2019 | Tao | F21V 23/003 |

FOREIGN PATENT DOCUMENTS

| | | | |
|---|---|---|---|
| CN | 201615369 | U | 10/2010 |
| CN | 201754641 | U | 3/2011 |
| CN | 104470086 | A | 3/2015 |
| CN | 104540304 | A | 4/2015 |
| CN | 107529713 | A | 1/2018 |

* cited by examiner

*Primary Examiner* — Alexander H Taningco
*Assistant Examiner* — Syed M Kaiser

(57) ABSTRACT

The present invention discloses a universal LED tube including a metal pin, an automatic dividing frequency network, a high-frequency driver, a low-frequency driver, a isolation circuit and a LED lighting set. The universal LED tube has the advantages of strong universality and high level of safety.

4 Claims, 3 Drawing Sheets

UNIVERSAL LED TUBE AND MODULE THEREOF

FIELD OF THE INVENTION

The present invention relates to the LED field and, in particular, to a universal LED tube and its module.

DESCRIPTION OF THE RELATED ART

An LED tube is used to directly replace a fluorescent tube on the traditional fluorescent lamp to achieve the significant effects of energy conservation, emission reduction, improvement of luminous efficiency and luminous environment and cost reduction.

However, a ballast used in fluorescent lamps is typically divided into inductive ballast and electronic ballast, and the working principle, circuit connection method and output voltage of these two ballasts are completely different, and especially, the frequency of output voltage and current varies hugely; the power frequency of voltage and current output from the general ballast is 50/60 Hz and the high-frequency voltage and current output from the electronic ballast is 25 KHz-80 KHz.

According to different types of ballasts used in traditional fluorescent lamps, the existing LED tubes designed and manufactured separately adopt two different technical schemes of inductive compatibility or electronic compatibility.

In the actual direct replacement, users are difficult to distinguish these two types except for professional electricians, and if they are mixed, the LED tube will be damaged and even a fire and a personal safety accident will be caused.

The existing LED tubes are not provided with the universal advantage and cannot be commodities in circulation, so the application field of energy-saving improvement and its promotion speed and scope are greatly restricted.

BRIEF DESCRIPTION OF THE INVENTION

This present application provides a universal LED tube and its module. The technical scheme used to solve the prior art fails to be used universally and has the problem of low safety level.

In one aspect, a universal LED tube is provided, which comprises a metal pin, an automatic dividing frequency network, a high-frequency driver, low-frequency driver, a isolation circuit and an LED lighting set, wherein two ports of the metal pin are separately connected with two input terminals of the automatic dividing frequency network, the output terminal A of the automatic dividing frequency network is connected to the positive input terminal of the high-frequency driver, the output terminal B is connected to the negative input terminal of the high-frequency driver, the output terminal C is connected to the positive input terminal of the low-frequency driver, and the output terminal D is connected to the negative input terminal of the low-frequency driver;

the output terminals of both high-frequency driver and low-frequency driver are connected with the input terminals of the isolation circuit and the output terminals of the isolation circuit are separately connected with the positive and negative poles of the LED lighting set;

when the input terminal is a high-frequency power supply, the automatic dividing frequency network is used to output the high-frequency power supply via output the terminals A and B, and when the input terminal is a power-frequency power supply, the automatic dividing frequency network is used to output the power-frequency power supply via output the terminals C and D.

Optionally, the universal LED tube comprises a fuse, and the fuse is disposed between a metal pin and an automatic dividing frequency network.

Optionally, the automatic dividing frequency network consists of a VDR, a capacitor, an inductor and a bidirectional triode thyristor; wherein two pairs of the metal pins are separately connected with the upper and lower ends of the voltage-dependent resistor via the fuse, the upper end of the voltage-dependent resistor is respectively connected to one end of a first inductor; a first capacitor, a first bidirectional triode thyristor and a first resistor, and the lower end of the voltage-dependent resistor is connected to one end of a second inductor, a second capacitor, a second bidirectional triode thyristor and a second resistor; the other end of the first capacitor is connected with the trigger electrode of the first bidirectional triode thyristor and the other end of the second capacitor is connected with the trigger electrode of the second bidirectional triode thyristor;

the other end of the first bidirectional triode thyristor is respectively connected with the other end of the first resistor and one end of the third resistor and the fourth capacitor and the other end of the third resistor is connected with the other end of the fourth capacitor in parallel as the output terminal A of the automatic dividing frequency network;

the other end of the second bidirectional triode thyristor is connected with the other end of the second resistor and one end of the fourth resistor and the fifth capacitor and the other end of the fourth resistor is connected with the other end of the fifth capacitor in parallel as the output terminal B of the automatic dividing frequency network;

the other end of the first inductor is connected with one end of the third capacitor as the output terminal C of the automatic dividing frequency network;

the other end of the second inductor is connected with the other end of the third capacitor as the output terminal D of the automatic dividing frequency network.

Optionally, the isolation circuit comprises a first diode and a second diode; wherein the anode of the first diode is connected with the positive output terminal of the high-frequency driver, the cathode of the first diode is connected with the positive electrode of the LED lighting set, and the negative electrode of the LED lighting set is connected with the negative output terminal of the high-frequency driver;

the anode of the second diode is connected with the positive output terminal of the low-frequency driver, the cathode of the second diode is connected with the positive electrode of the LED lighting set, and the negative electrode of the LED lighting set is connected with the negative output terminal of the low-frequency driver.

The technical scheme provided by the present invention has the advantages of realization of two types of different ballasts, strong universality and high level of safety.

BRIEF DESCRIPTION OF THE DRAWINGS

To illustrate the technical schemes in the embodiments of the present invention more clearly, the required figures described in the embodiments will be introduced briefly. Obviously, the figures described hereunder are just some embodiments of the present invention. For those of ordinary skill in the art, they can also obtain other figures based on these figures without creative work.

DETAILED DESCRIPTION OF THE PREFERRED EMBODIMENTS

The technical scheme in the embodiments of the invention will be described clearly and completely as follows in combination with the drawings in the embodiments of the present invention. Apparently, the embodiments described are some embodiments of the present invention, but not all embodiments. Based on the embodiments of the present invention, all other embodiments obtained by those of ordinary skill in the art without creative work fall within the protection scope of the present invention.

Figure 1A:
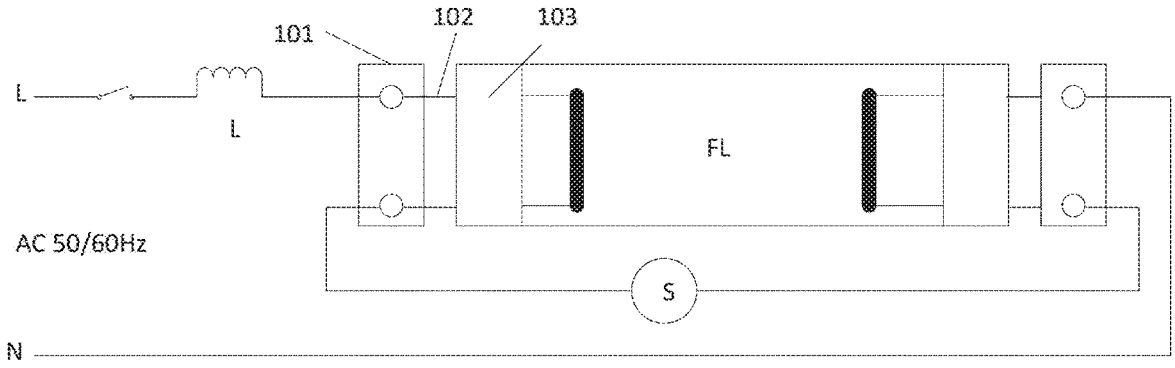
FIG. 1*a* is a schematic view of the circuit of an inductive ballast used in the existing fluorescent lamps.

FIG. 1*a* is a wiring diagram of the fluorescent lamp with an existing inductive ballast, K is a power switch and L is an inductive ballast, it further includes a lampholder 101, a metal pin 102, a lamp cap 103, a starter S, a fluorescent tube FL, a live wire L and neutral wire N of mains supply.

Figure 1B:
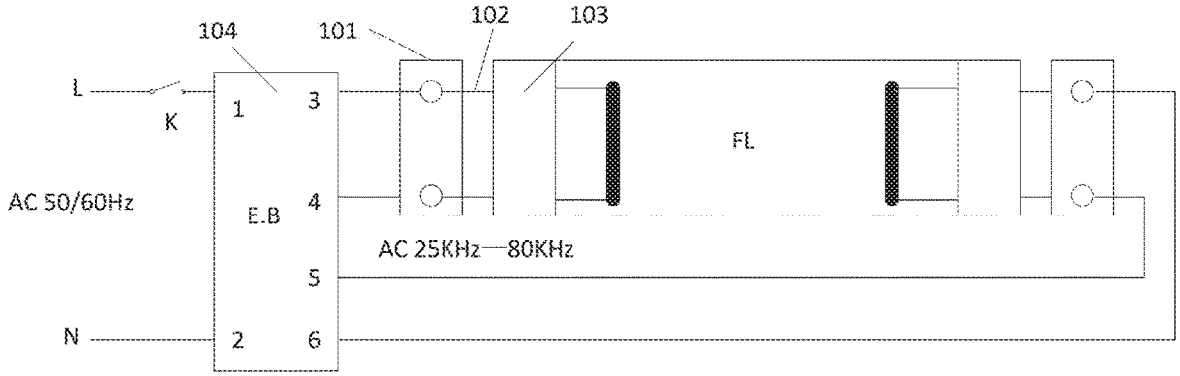
FIG. 1*b* is a schematic view of the circuit of an electronic ballast used in the existing fluorescent lamps.

FIG. 1*b* is a wiring diagram of the traditional fluorescent lamp with an electronic ballast, and the electronic ballast is (E.B) 104.

Figure 2:
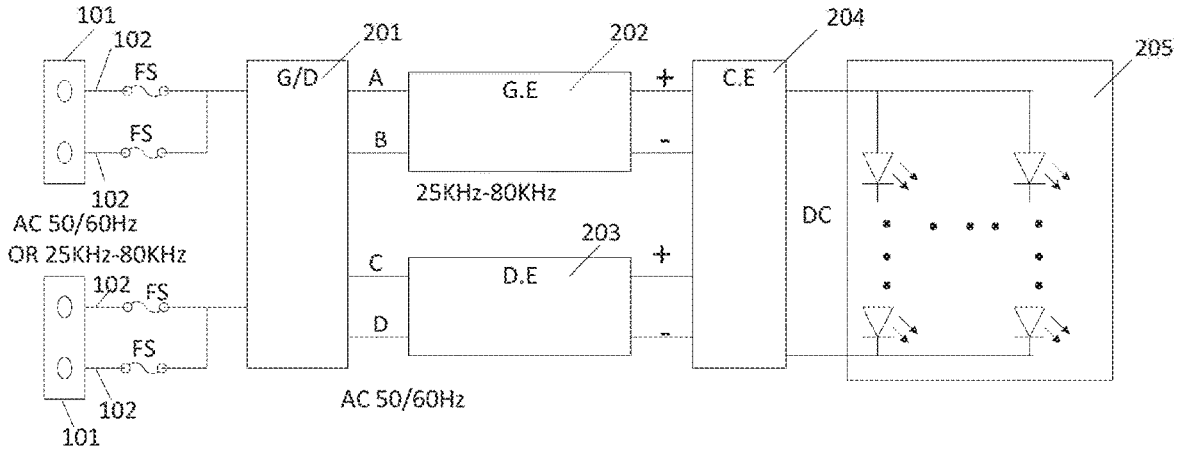
FIG. 2 is a schematic block diagram of the universal LED tube provided in the preferred embodiment of the present invention.

FIG. 2 is an electrical schematic block diagram of the present invention, and the metal pin 102 in FIG. 2 is used to introduce AC 50/60 Hz (power-frequency power supply) or 25 KHz-80 KHz thigh-frequency power supply) on the lampholder 101 into the automatic dividing frequency network 201 (G/D) via the fuse FS, and when the power supply signal introduced is a high-frequency signal, the automatic dividing frequency network 201 will output the high-frequency power supply to the high-frequency driver 202 via terminals A and B and convert the high-frequency alternating current to the direct current so as to drive the operation of the LED lighting set 205 via the isolation circuit 204, and in this case, no current is supplied to Terminals C and D of the low-frequency driver 203.

When the power supply introduced by the metal pin 102 is the power frequency, the automatic dividing frequency network 201 will output the power-frequency power supply to the low-frequency driver 203 via the terminals C and D and convert the power-frequency alternating current to the direct current so as to drive the operation of the LED lighting set 205 via the isolation circuit 204, and in this case, no current is supplied to the terminals A and B of the high-frequency driver 202.

Figure 3:
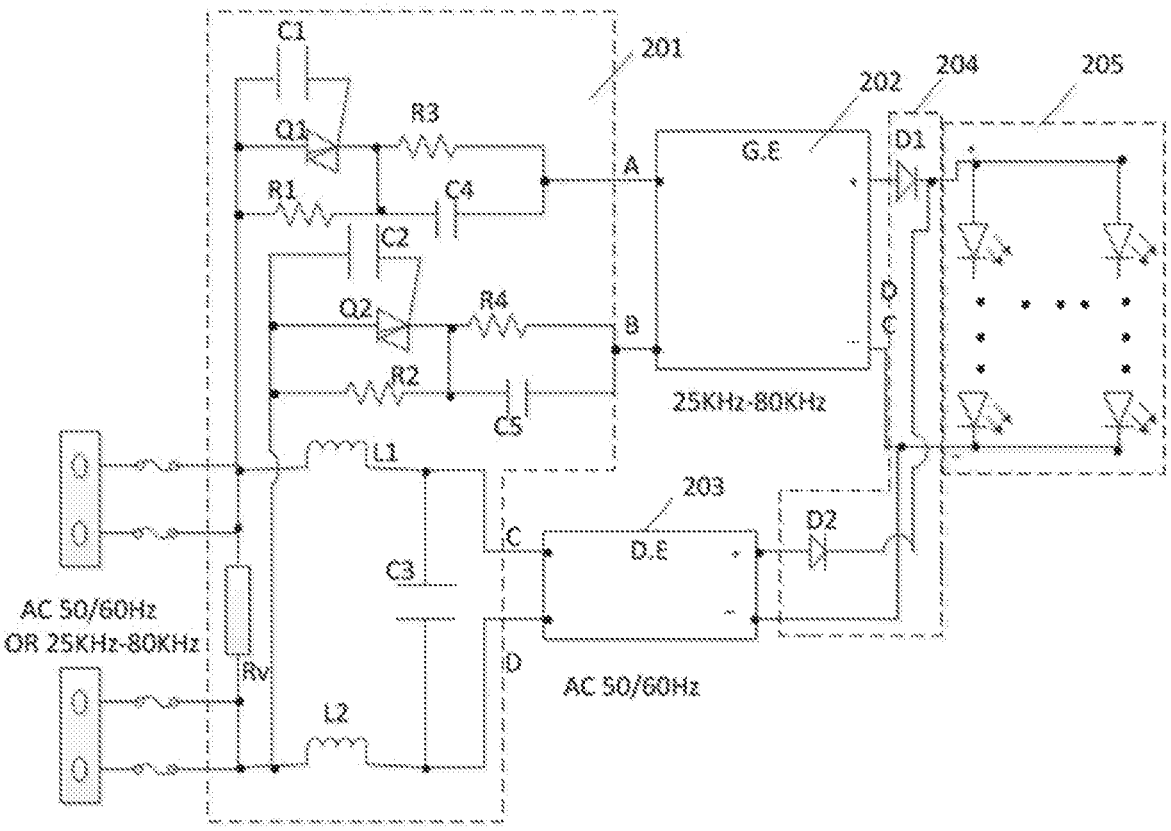
FIG. 3 is art electrical schematic view provided in the embodiment of the present invention.

FIG. 3 is a schematic view of the embodiment of the present invention, and the inductive or electronic ballasts on two lampholders 101 on the lamp output electric signals, two pairs of the metal pins 102 on two lamp caps 103 are separately connected to the upper and lower ends of the voltage-dependent resistor (VDR) Rv via the fuse FS, the upper end of the voltage-dependent resistor Rv is connected, to one end of the inductor L1, capacitor C1, bidirectional triode thyristor Q1 and resistor R1, and the lower end of the voltage-dependent resistor Rv is connected to one end of the inductor L2, capacitor C2, bidirectional triode thyristor Q2 and resistor R2. The other end of capacitors C1 and C2 are separately connected with the trigger electrodes of bidirectional triode thyristors Q1 and Q2.

The other end of the bidirectional triode thyristor Q1 is connected to the other end of the resistor R3 and one end of the capacitor C4, and the other end of resistor R3 is connected to the other end of capacitor C4 in parallel to connect the output terminal A of the automatic dividing frequency network 201.

The other end of the bidirectional triode thyristor Q2 is connected to the other end of the resistor R2 and one end of the resistor R4 and capacitor C5, and the other end of the resistor R4 is connected to the other end of the capacitor C5 in parallel to connect the output terminal B of the automatic dividing frequency network 201.

The other end of the inductor L1 is connected to one end of the capacitor C3 to connect the output terminal C of the automatic dividing frequency network 201.

The other end of the inductor L2 is connected to the other end of the capacitor C3 to connect the output terminal D of the automatic dividing frequency network 201.

Diodes D1 and D2 form the isolation circuit 204 of a high-frequency driver and a low-frequency driver output, wherein the positive electrode of the diode D1 is connected to the positive electrode of the DC output of the high-frequency driver 202, the positive electrode of the diode D2 is connected to the positive electrode of the DC output of the low-frequency driver 203, the negative electrodes of diodes D1 and D2 are connected together to form the positive electrode of the DC power supply of the LED lighting set 205, and the negative electrodes of the DC output of the high-frequency driver and the low-frequency driver are connected together to form the negative electrode of the DC power supply of the LED lighting set 205.

When the signals of two ends of the voltage-dependent resistor Rv in the dividing frequency network 201 are the high-frequency signals of 25 KHz-80 KHz, the trigger electrodes of the bidirectional triode thyristors Q1 and Q2 will obtain the trigger current via the capacitors C1 and C2 for effective breakover, and after the breakover of Q1 and Q2 is realized, the high-frequency signals of 25 KHz-80 KHz of both ends of the voltage-dependent resistor Rv are output to the terminals A and B of the automatic dividing frequency network 201 via R3, C4 and R4, C5 so as to drive the operation of LED lighting set 205 via the isolation circuit 204 after they are rectified and filtered by the high-frequency driver 202. In this case, the inductors L1 and L2 form high inductive impedance for the high-frequency electrical signals of 25 KHz-80 KHz on both ends of the voltage-dependent resistor Rv, so no current is introduced to the low-frequency driver 203.

When the electrical signals on both ends of the voltage-dependent resistor Rv in the automatic dividing frequency network 201 are the power-frequency signals of 50/60 Hz, such low-frequency electrical signals are output to the terminals C and D of the automatic dividing frequency network 201 via the inductors L1 and L2 so as to drive the operation of LED lighting set 205 via the isolation circuit 204 after they are rectified and filtered by the low-frequency driver 202 and the constant current is formed through the pulse-width modulation (PWM), and in this case, the capacitors C1 and C2 form huge capacitive reactance for the power frequency, thus bidirectional triode thyristors Q1 and Q2 are not provided with trigger current and are in the cut-off state and no current is not supplied to the high-frequency driver 202.

The automatic dividing frequency network 201, high-frequency driver 202, low-frequency driver 203, isolation circuit 204 and LED lighting set 205 are disposed in the present invention, so that the fluorescent tubes on the traditional electronic and inductive ballasts of fluorescent lamps can be directly replaced and the mains supply can be directly supplied to them for normal operation.

Figure 4:
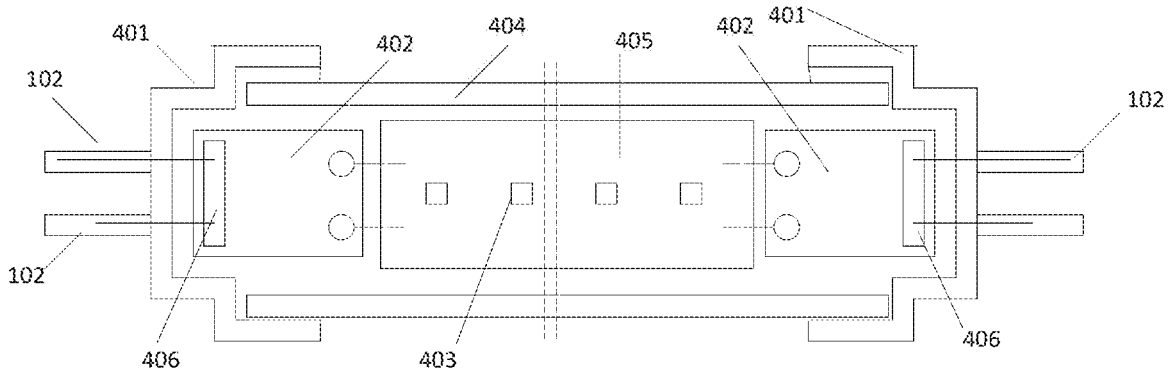
FIG. 4 is a schematic view of the structure in the embodiment of the present invention.

FIG. 4 is a schematic view of the structure in the embodiment of the present invention, there are two plastic lamp caps 401, LED lamp bead 403, glass or plastic tube 404, LED batten 405 and fuse in FIG. 4, and automatic dividing frequency network 201, high-frequency driver 202, low-frequency driver 203, isolation circuit 204 are separately disposed on the circuit board 402 on both ends, and the circuit board 402 on both ends are separately arranged in metal pin 102 of two plastic lamp caps 401 via copper pin headers 406.

Figure 5C:
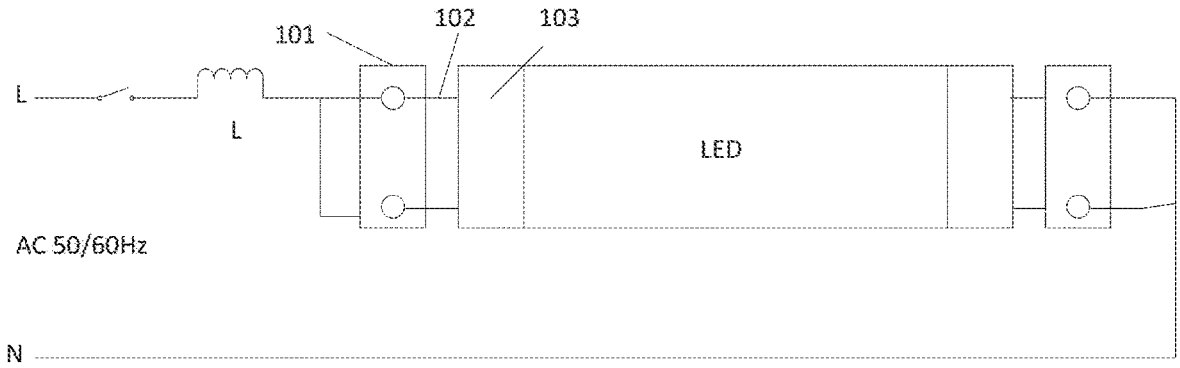
FIG. 5*c* is a circuit diagram of the fluorescent tube driven by an inductive ballast to be directly replaced in the embodiment of the present invention.

FIG. 5*c* is a circuit diagram of the fluor r tube driven by an inductive ballast to be directly replaced, and in this case, the starter S on the original fluorescent lamp shall be disassembled from the starter holder.

Figure 5D:
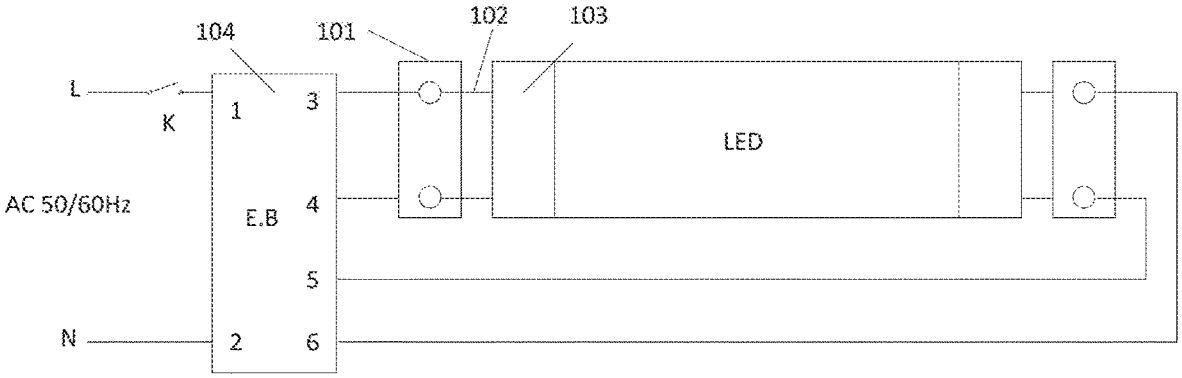
FIG. 5*d* is a circuit diagram of the fluorescent tube driven by an electronic ballast to be directly replaced in the embodiment of the present invention.

FIG. 5*d* is a circuit diagram of the fluorescent tube driven by an electronic ballast to be directly replaced.

Figure 5E:
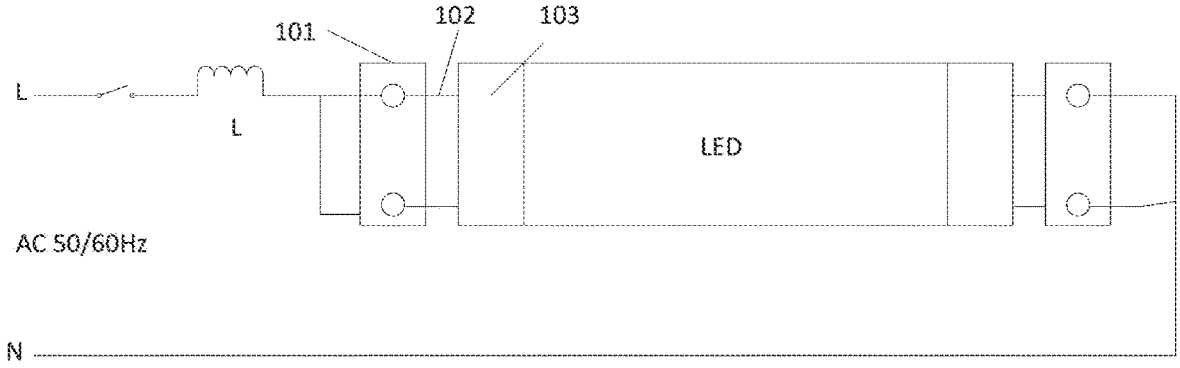
FIG. 5*e* is a circuit diagram of direction connection to the mains supply in the embodiment of the present invention.

FIG. 5*e* is a circuit diagram of direct connection to the mains supply of AC 100-277V 50/60 Hz.

It should be noted that the aforesaid method embodiments are described as a series of combinations of actions to simplify the description, but it will be understood by those skilled in the art that the present invention is not limited by the sequence of actions described, because some steps can adopt other sequences or can be conducted simultaneously according to the present invention. Next, it will also be understood by those skilled in the art that the embodiments described in the Specifications belong to the preferred embodiments and the actions and modules involved are not necessarily required by the present invention.

In the aforesaid embodiments, different emphases are put on the description of various embodiments, and for any part not described in detail in some embodiment, refer to the relevant description of other embodiments.

Those of ordinary skill in the art can understand that all or par of steps in various methods in the embodiments can be completed by using a program to instruct the relevant hardware, and this program can be stored in a readable storage medium of computer, and the storage medium may comprise: flash disk, Read-Only Memory (ROM), Random Access Memory (RAM), magnetic disk, optical disk or the like.

The download methods of contents and relevant equipment and systems provided in the embodiments of the present invention are described in detail therein before, and specific embodiments are applied to set forth the principle and method of implementation of the present invention, and the foregoing illustration of embodiments is only used to assist in understanding the methods and core concepts of the present invention. Simultaneously, those of ordinary skill in the art can revise the specific implementation and scope of application according to the concepts of the present invention. To sum up, the contents of the present invention should not be understood as the restrictions on the present invention.

What is claimed is:

1. A universal LED tube, comprising:

a metal pin, an automatic dividing frequency network, a high-frequency driver, a low-frequency driver, a isolation circuit and a LED lighting set, wherein two ports of the metal pin are respectively connected with two input terminals of the automatic dividing frequency network, an output terminal (A) of the automatic dividing frequency network is connected to the positive input terminal of the high-frequency driver, an output terminal (B) of the automatic dividing frequency network is connected to the negative input terminal of the high-frequency driver, an output terminal (C) of the automatic dividing frequency network is connected to the positive input terminal of the low-frequency driver, and an output terminal (D) of the automatic dividing frequency network is connected to the negative input terminal of the low-frequency driver;

the output terminals of both the high-frequency driver and low-frequency driver are connected with the input terminals of the isolation circuit and the output terminals of the isolation circuit are respectively connected with the positive and negative poles of the LED lighting set;

when the input terminal of the automatic dividing frequency network is a high-frequency power supply, the automatic dividing frequency network is used to output the high-frequency power supply via output the terminals (A and B), and when the input terminal of the automatic dividing frequency network is a power-frequency power supply, the automatic dividing frequency network is used to output the power-frequency power supply via output the terminals (C and D).

2. The universal LED tube as claimed in claim 1, wherein the universal LED tube comprises a fuse, and the fuse is disposed between the metal pin and the automatic dividing frequency network.

3. The universal LED tube as claimed in claim 2, wherein the automatic dividing frequency network comprises a voltage-dependent resistor, a capacitor, an inductor and a bidirectional triode thyristor; and wherein two pairs of the metal pins are respectively connected with the upper and lower ends of the voltage-dependent resistor via the fuse, the upper end of the voltage-dependent resistor is respectively connected to one end of a first inductor a first capacitor, a first bidirectional triode thyristor and a first resistor, and the lower end of the voltage-dependent resistor is respectively connected to one end of a second inductor, a second capacitor, a second bidirectional triode thyristor and a second resistor; the other end of the first capacitor is connected with a trigger electrode of the first bidirectional triode thyristor and the other end of the second capacitor is connected with a trigger electrode of the second bidirectional triode thyristor;

the other end of the first bidirectional triode thyristor is respectively connected with the other end of the first resistor and one end of the third resistor and the fourth capacitor and the other end of the third resistor is connected with the other end of the fourth capacitor in parallel as the output terminal (A) of the automatic dividing frequency network;

the other end of the second bidirectional triode thyristor is connected with the other end of the second resistor and one end of the fourth resistor and the fifth capacitor and the other end of the fourth resistor is connected with the other end of the fifth capacitor in parallel as the output terminal (B) of the automatic dividing frequency network;

the other end of the first inductor is connected with one end of the third capacitor as the output terminal (C) of the automatic dividing frequency network;

the other end of the second inductor is connected with the other end of the third capacitor as the output terminal (D) of the automatic dividing frequency network.

4. The universal LED tube as claimed in claim 3, wherein the isolation circuit comprises a first diode and a second diode, and wherein an anode of the first diode is connected with a positive output terminal of the high-frequency driver, an cathode of the first diode is connected with a positive electrode of the LED lighting set, and a negative electrode of the LED lighting set is connected with a negative output terminal of the high-frequency driver;

an anode of the second diode is connected with a positive output terminal of the low-frequency driver, a cathode of the second diode is connected with the positive electrode of the LED lighting set, and the negative electrode of the LED lighting set is connected with a negative output terminal of the low-frequency driver.

* * * * *